US006648363B2

(12) United States Patent
Gordon

(10) Patent No.: US 6,648,363 B2
(45) Date of Patent: Nov. 18, 2003

(54) COMPOSITE SPORTS BOARD SUCH AS A SKATEBOARD DECK

(76) Inventor: Shale Gordon, 1053 14th St., Hermosa Beach, CA (US) 90254

( * ) Notice: Subject to any disclaimer, the term of this patent is extended or adjusted under 35 U.S.C. 154(b) by 21 days.

(21) Appl. No.: 10/006,061

(22) Filed: Dec. 5, 2001

(65) Prior Publication Data

US 2003/0102650 A1 Jun. 5, 2003

(51) Int. Cl.[7] ..... B62M 1/00
(52) U.S. Cl. ..... 280/610; 280/87.042; 428/537.1
(58) Field of Search ..... 280/610, 87.042, 280/87.041, 14.21, 602, 609; 428/537.1

(56) References Cited

U.S. PATENT DOCUMENTS

| | | | | | |
|---|---|---|---|---|---|
| 4,395,263 | A | * | 7/1983 | Davis | 8/471 |
| 4,810,551 | A | * | 3/1989 | Chu | 428/106 |
| 4,921,513 | A | * | 5/1990 | Parten | 156/280 |
| 5,271,996 | A | * | 12/1993 | Tanabe et al. | 442/226 |
| 5,591,509 | A | * | 1/1997 | Lorenz et al. | 428/107 |
| 5,759,664 | A | * | 6/1998 | Chisnell et al. | 428/109 |
| 6,059,307 | A | * | 5/2000 | Western | 280/609 |
| 6,182,986 | B1 | * | 2/2001 | Smith | 280/87.042 |
| 6,386,561 | B1 | * | 5/2002 | Hanson | 280/87.042 |
| 6,460,868 | B2 | * | 10/2002 | Madrid | 280/87.042 |
| 2002/0185835 | A1 | * | 12/2002 | Wen | 280/87.041 |

FOREIGN PATENT DOCUMENTS

WO WO 01/66411 A1 * 9/2001 ..... B63B/35/79

OTHER PUBLICATIONS

Robert August model skateboard. Illustration [online]. Bambusa, 3626 Berryfield Ct., San Diego, California 92130. [retrieved on Nov. 28, 2001] Retrieved from the internet:<URL:http://www.bambusa.com/frames.html>.

Bambusa model skateboard. Illustration [online]. Bambusa, 3626 Berryfield Ct., San Diego, California 92130. [retrieved on Nov. 28, 2001] Retrieved from the internet:<URL:http://www.bambusa.com/frames.html>.

Robert August and Bambusa model skateboards. Datasheet [online]. Bambusa, 3626 Berryfield Ct., San Diego, California 92130. [retrieved on Nov. 28, 2001] Retrieved from the internet: <URL: http://www.bambusa.com/about2.html>.

Ulrike G.K. Wegst and Michael F. Ashby, "Environmentally–Conscious Material Selection and Design of Sports Equipment." To be published in the Proceedings of The 3rd International Sports Engineering Association Conference on the Engineering of Sport (2000).

International Patent Application No. PCT/AU01/00253 entitled, "Method of Manufacturing a Watercraft".

* cited by examiner

*Primary Examiner*—Brian L. Johnson
*Assistant Examiner*—J. Allen Shriver
(74) *Attorney, Agent, or Firm*—Michael Hoffman; Andrew Naglestad; The Soni Law Firm

(57) ABSTRACT

A composite material for use as a skateboard deck or other sports board. The composite skateboard deck of the preferred embodiment is comprised of two structural layers bonded to and on either side of a light, flexible core. The structural layers made of a strong, resilient material comprised of a natural fiber-embedded-matrix, this class of materials including grasses such as bamboo, hemp and kanaf. The composite skateboard deck of the present invention is strong, light, durable, resilient, environmentally friendly, and derived from a more renewable resource with no loss of pop or memory.

17 Claims, 2 Drawing Sheets

COMPOSITE SPORTS BOARD SUCH AS A SKATEBOARD DECK

BACKGROUND

The present invention relates to a laminated structure for use as sports equipment incorporating a strong, resilient, flexible board, plank or sheet structure and its method of manufacture. More particularly, the invention relates to a composite structure including natural fibrous material such as bamboo for fabricating sports boards such as skateboard decks and the process for constructing such sports boards.

There are numerous types of boards used for sports which are fabricated from solid and, more commonly, composite board structures. This class of equipment is herein referred to as sports boards and includes but is not limited to skateboard decks, snow boards, skim boards without foam cores, wake boards, wave boards, kite boards, snow-skateboards, sail boards, micro-skis, and snow skis. Each of these articles is constructed from a substantially planar structure commonly formed by laminating multiple layers of natural and/or man-made materials into a composite material that is strong, resilient and flexible. Composites for a skateboard decks, including wood or plastic for example, are flexible enough to withstand the dynamic forces exerted on it by the user without breaking and without significant degradation of the board's "memory," i.e. the ability to return to its original form after flexing without degradation.

In addition to being strong, resilient and flexible, sports boards should be light weight, impact resistant, inexpensive, easy to work with, lend themselves to non-planar shapes and curves, be environmentally friendly and aesthetically pleasing.

One prior art skateboard is sold by BAMBUSA™ of San Diego, Calif. The skateboard deck appears in plan view to include numerous strips of bamboo that run the length of the deck. The bamboo strips are approximately one inch wide and adjacently abutted to create joints that run from the front of the board to the tail. The skateboard is also advertised as being comprised of "100% bamboo." With a solid bamboo core and exterior, this deck teaches away from the use of "sandwich" construction techniques that employ strong outer layers with a light-weight interior core. The resulting BAMBUSA™ skateboard deck is relatively heavy and more rigid than the present invention for a given board width and thickness.

Co-pending PCT application no. PCT/AU01/00253 discloses a watercraft such as a surfboard comprising a foam inner core and an outer layer of bamboo veneer. The PCT application does not disclose the use of structural layers of strong, resilient material comprised of natural fiber-embedded-matrix or the manner of joining sheets of these materials to create structural layers for use with composite sports board of the present invention. In addition, the foam inner core of the PCT application is necessary to enhance the watercraft's buoyancy but is generally less resilient than the materials conventionally employed in the fabrication of skateboard decks and is unacceptable for such use. The PCT application does not disclose or suggest the use of these more resilient and more flexible composite materials which are important in fabricating skateboards with suitable flex-pop and memory.

SUMMARY

The present invention relates to a composite sports board and its method of fabrication. The board is comprised of a first structural layer of a strong, resilient material comprised of natural fiber-embedded-matrix; a second structural layer optionally, albeit preferably, constructed from the said strong, resilient material; a flexible core interposed between the first and second structural layers; an adhesive for fixedly attaching the first and second structural layers to the core. The board may be adapted to receive one or more additional accessories suited for the particular type of sports board. For example, the sports board may include means for mounting wheels as in the case of a skateboard; means for mounting bindings as in the case of a snow ski, micro-ski, snow board, kite board, wake board, sail board, or water ski; or means for mounting a paddle or accommodating a seat as in the case of a wave ski.

The strong, resilient material comprised of natural fiber-embedded-matrix of the present invention includes organic materials having bundles of cellulose fibers embedded in a matrix such as pectin. In some embodiments, the strong, resilient material is a grass such as bamboo. Some species of bamboo including Moso, *D. asper, B. blumeana,* and *D. latiflorus* are particularly well suited for board construction because of their strength-to-weight ratio and resilience under abusive riding conditions. Although subject to variation depending on the application, the bamboo component of the skateboard deck of the preferred embodiment is a veneer between 0.1 and 1.5 mil in thickness. The one or more plies of the core may be selected from a wide variety of natural and man-made products that are relatively light and flexible, including plastics and woods such as Canadian Maple.

In some embodiments, the bamboo veneer is fabricated from a plurality of bamboo sheets that are "pealed" or turned from a pole of bamboo. These sheets may be trimmed at or near a point corresponding to the node of the bamboo pole. The individual sheets when bonded together and applied to the deck of the preferred embodiment may have an overlapping joint that runs laterally across the width of the board. The result is a relatively large, continuous sheet of bamboo veneer that is capable of being used as a structural or weight bearing member in the composite board of the present invention while preserving the aesthetic appeal of the natural bamboo.

The use of a natural fiber-embedded-matrix such as bamboo as the primary structural or weight bearing member results in a composite sports board that is strong and light, exhibits better "flex-pop" and memory, is more resilient, more environmentally friendly and derived from a more renewable resource than existing composite boards. Pop is the ability of the board to flexibly spring under load and maintain a high recoil speed with minimal fatigue.

DETAILED DESCRIPTION OF THE PREFERRED EMBODIMENT

The present invention pertains to a sports board, which refers to a category of sporting equipment having a strong, resilient, flexible and substantially flat structure conventionally made of one or more materials including wood, plastic and fiber glass or carbon fiber. The class of sports boards is comprised of skateboards, kite boards, snow boards, snow-skateboards, skim boards without foam cores, sail boards, wake boards, wave boards, micro-skis and snow skis.

Figure 1:
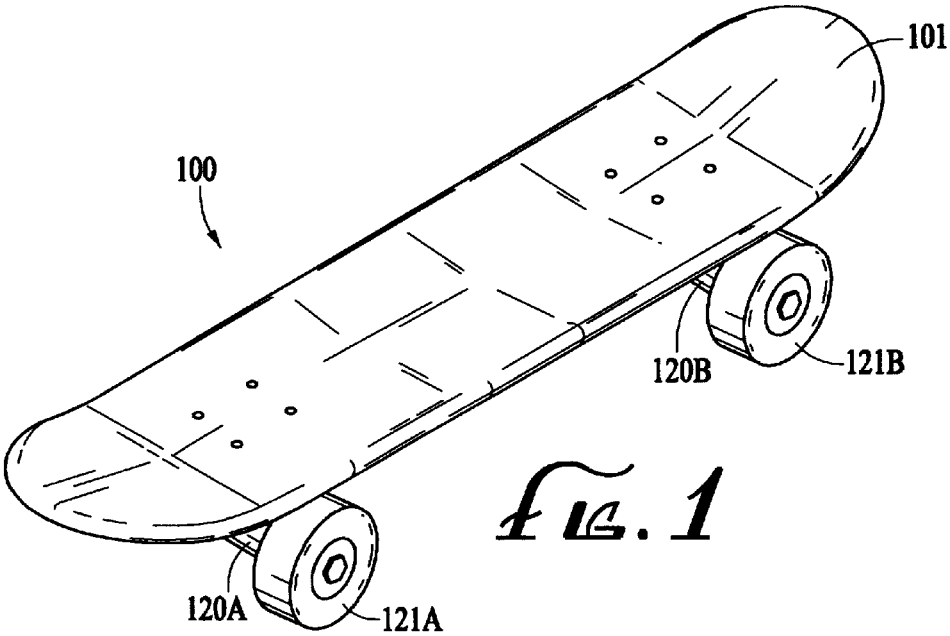
FIG. 1 is an isometric view of a skateboard including the composite sports board of the preferred embodiment.

Referring to FIG. 1, a skateboard including the composite sports board of the preferred embodiment is illustrated. The skateboard 100 includes a composite skateboard deck 101, trucks 120A and 120B, and wheels 121A and 121B.

Figure 2:
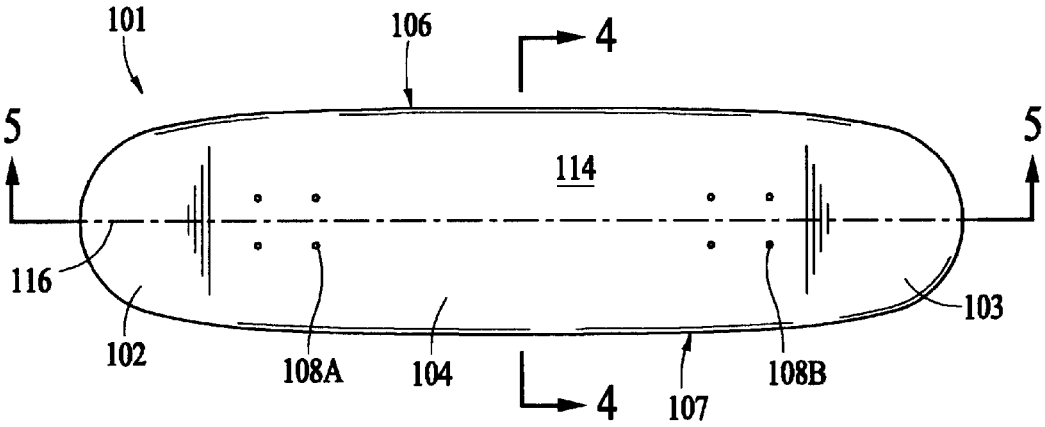
FIG. 2 is a plan view of the composite skateboard deck of the preferred embodiment of the sports board of the present invention.

Referring to FIG. 2, the composite skateboard deck of the preferred embodiment is illustrated in plan view. The deck 101 includes a nose 102, tail 103 and middle section 104. The length and width of the deck 101 is subject to vary depending on application. In general, standard and long boards are in the range of 30 to 48 inches in length and in the range of 7 to 20 inches wide. The deck 101 also includes truck mounting means for affixing the trucks and wheels. The truck mounting means in the preferred embodiment is comprised of a first set of holes 108A and a second set of holes 108B in a standard configuration for receiving bolts (not shown) that engage and secure the trucks 120A and 120B to the deck 101.

Figure 3:
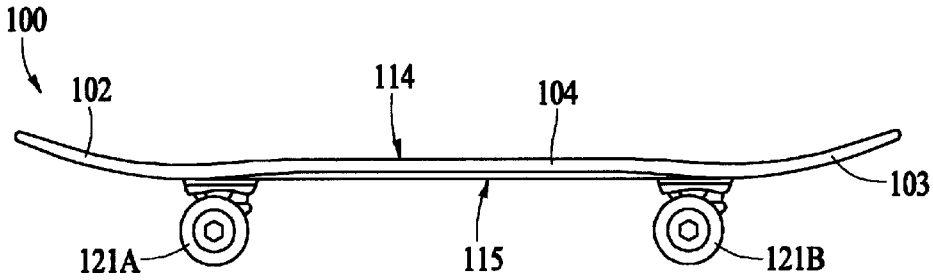
FIG. 3 is a side view of the composite skateboard deck of the preferred embodiment of the sports board of the present invention.

Referring to FIG. 3, the composite skateboard deck 101 of the preferred embodiment is illustrated in elevation. As seen, the nose 102 and tail 103 are constructed in the preferred embodiment with an upward angle with respect to the middle section 104 to facilitate the placement of a rider's feet and increase the maximum angle inclination. The middle section 104 is substantially flat in the preferred embodiment, but may include a concavity from nose to tail and/or from side to side. The top surface 114 of the board may optionally include a grip, textured surface or other frictional surface for purposes of reducing slipping and increasing the rider's ability to maintain contact with the deck 101.

Figure 4:
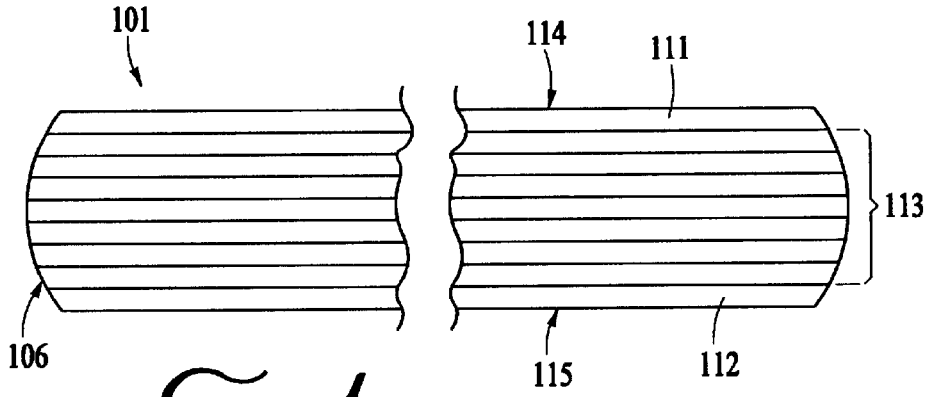
FIG. 4 is a diagrammatic cross section perpendicular to the longitudinal axis of the composite skateboard deck of the preferred embodiment of the present invention

Referring to FIG. 4, the composite skateboard deck 101 of the preferred embodiment is illustrated in cross section perpendicular to the longitudinal axis 116 (see FIG. 2) to show the constituent layers. The first structural layer 111 and the second structural layer 112 are the primary load-bearing members and support the weight and dynamic forces exerted by the rider. The first and second structural layers are separated by a relatively light, flexible core 113 comprised of one or more plies or layers. According to the present invention, the sports board includes at least one and preferably two or more structural layers constructed from a strong, resilient material of natural fiber-embedded-matrix. This class includes materials having bundles of cellulose fibers running the length of the pole, or culm, embedded in a matrix such as pectin. Grasses such as bamboo, hemp and kanaf qualify as strong, resilient materials of natural fiber-embedded-matrix and are particularly well suited for constructing durable, high-performance sports boards.

In particular, bamboo has a strength-to-weight ratio that is nearly equal to that of steel. As such, bamboo is able to withstand the forces of tension and compression exerted by even extreme skateboarders without breaking and with substantially no degradation of the board's "memory" that is, the ability to repeatedly flex within its maximum operational range and still return to its pre-loaded, unflexed shape with maximal restoring force. Moreover, bamboo skateboard decks according to the present invention exhibit good "pop," that is the ability of the board to flexibly spring under load and maintain a high recoil speed with minimal fatigue.

As recognized by one skilled in the art, the core 113 may be comprised of any number of different materials that are flexible and relatively light in comparison to the structural layers, the most prevalent being plastic and woods such as Canadian Maple. The first and second structural layers 111 and 112 when combined with the core 113 are strong enough to withstand the dynamic forces exerted by a rider doing "tricks" or other extreme maneuvers without breaking.

In the preferred embodiment, the bamboo from which the first and second structural layers 111 and 112 are comprised is Moso (*Phyllostachys heterocycla pubescens*) bamboo preferably, although many other species of bamboo such as *D. asper* (*Dendrocalamus asper*), *D. latiflorus* (*Dendrocalamus latiflorus*), and *B. blumeana* (*Bambusa blumeana*) are also suitable. More particularly, the structural layers in the preferred embodiment are thin veneers generated from a "peal" of bamboo derived from the "timber" section of the bamboo pole. The timber section is an interior layer of fiberous tissue, specifically the second tissue layer below the bark of the bamboo pole, located approximately 2 meters above the ground of armature bamboo pole. The peal is formed by shaving a thin and continuous sheet of bamboo as the pole is rotated about its central axis.

The first and second structural layers 111 and 112 are preferably 0.3 mils thick and are substantially uniform across the upper surface 114 and lower surface 115 of the deck 101. The thickness of the first and second structural layers 111 and 112 may range on the order of 0.3 mils to 1.5 mils, but is subject to greater variation depending on the length and width of the deck 101, the thickness and type of core 113 as well as the desired flexibility of the skateboard 100.

The grain of the bamboo in the preferred embodiment, as defined by the direction of the fibers, is preferably oriented substantially parallel to the longitudinal axis 116 of the deck 101. When aligned with the long axis 116 of the deck 101, the grain is said to be oriented at zero degrees.

In the preferred embodiment, multiple plies or layers of Canadian Maple wood are bonded together and comprise the core 113. The number of plies of maple is preferably seven but may range between less than five and greater than nine. Where more than one ply is used, it is preferable to alternate the grain of the wood at zero and 90 degrees to enhance the strength and flexibility of the deck 101. The preferably thickness of the plies varies between 1.2 and 1.5 mils with the overall thickness of the deck being approximately 8 mils. In other embodiments, the core 113 may also be comprised of one or more layers of plastic, fiber glass or carbon fiber, for example.

The structural layers and the one or more plies comprising the core 113 are bonded together using an adhesive glue, polyester resin or epoxy resin. One skilled in the art will recognize that any one of the numerous other adhesives may be used provided that it is sufficiently viscous to avoid tearing the bamboo ply during application with a roller to the structural layer.

In some embodiments, one or more separate "sheets" of bamboo veneer are integrated to form a single structural layer. The sheets may include discontinuities in the fibers of the bamboo, for example, that correspond to the nodes of the original bamboo pole. These discontinuities appear as grainy lines and are structurally weaker than the section of pole between the nodes. Theses nodes or lines of structural weakness may be integrated into the structural layer for visual appearance with minimal loss of strength if made to run perpendicular to the grain with an overlap as described below.

Figure 5:
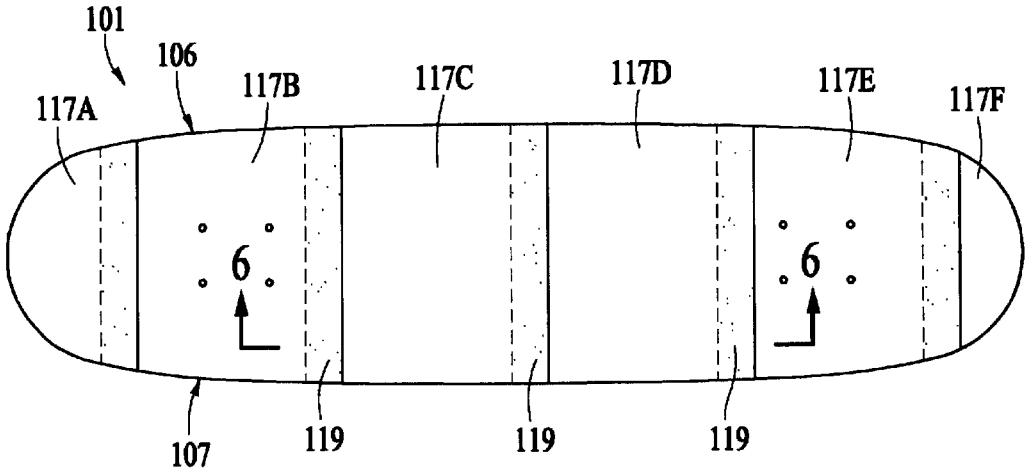
FIG. 5 is a plan view of the composite skateboard deck of the preferred embodiment illustrating a plurality of overlapping sheets of bamboo veneer.

Referring to FIG. 5, a plan view of the composite skateboard deck of the preferred embodiment showing a plurality of overlapping bamboo sheets is illustrated. The sheets 117A through 117F are joined head to tail along the length of the deck 101 to form the first structural layer 111. As illustrated, the representative sheets 117C and 117D are made to overlap, thereby creating a joint 119 that traverses the board from side 106 to side 107. The sheets are preferably bonded together in the region of overlap to maintain the structural integrity of the joint.

Figure 6:
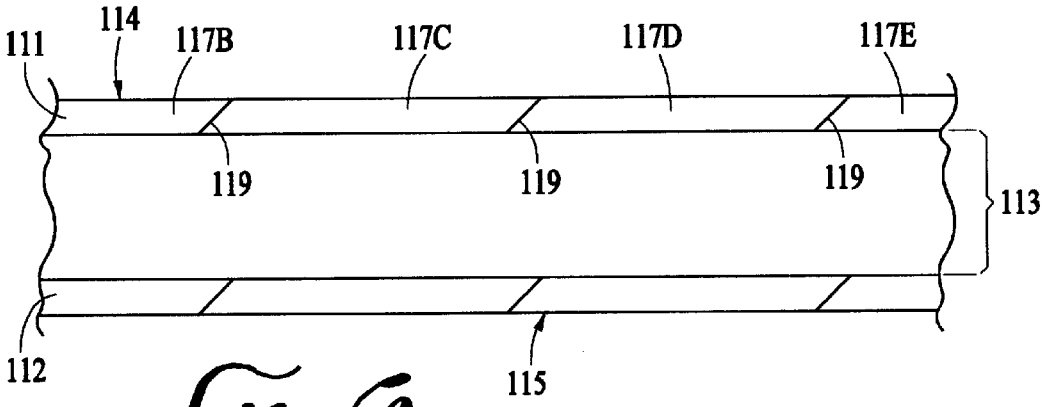
FIG. 6 is a diagrammatic cross section of the composite skateboard deck of the preferred embodiment parallel to its longitudinal axis.

Referring to FIG. 6, a cross section of the composite skateboard deck of the preferred embodiment parallel to its longitudinal axis is illustrated. As seen, the leading and trailing edges of the representative sheet 117C are tapered where they abut and overlap with sheets 117B and 117D to form joints 119. In an alternative embodiment, sheets without any taper may be made to overlap and the resulting joint made substantially level with the deck surface 114 or 115 by applying pressure to the joint or by sanding down the joint. The region of overlap 119 should be wide enough to compensate for the weakness of the node and maintain the overall structural integrity of the joint. The overlap at joint 119 is approximately one half to three eighths of an inch wide in the preferred embodiment.

The deck 101 of the preferred embodiment, after bonding the structural layers 111 and 112 and core 113 together, is preferably treated with a sealer to reduce scuffing and waterproof the deck 101. The exterior of the deck 101 including the upper and lower surfaces 114 and 115 are impregnated with the sealer, which may be polyester resin, epoxy resin or any one or numerous other products conventionally used by those skilled in the art. The resulting surface may be sanded as is capable of receiving varnish, paint, lacquer, graphics or other finishes.

The composite skateboard deck 101 of the preferred embodiment further includes truck mounting means, preferably two sets of holes 108A and 108B in a standardized pattern to accommodate the mounting of the trucks 120A and 120B.

The techniques and principles of design and construction of the composite skateboard deck 101 of the preferred embodiment described above may be adapted by one skilled in the art to make and use other sports boards. With appropriate variations in the length, width and thickness, sports boards of the present invention including snow boards, skim boards without foam cores, wake boards, wave boards, kite boards and snow skis, micro-skies, surfboards, kite-skis, sail-skis, kite-skateboards, kite-iceboards, sail boards, snow-skateboards, and skate-snowboards, for example, may be constructed. Although the other sports boards listed above may not include truck mounting means, they may include means for mounting bindings, straps including those manufactured from synthetic materials sold under the trademark VELCRO, tethers, paddles or be adapted to include a seat upon which a rider may sit, for example.

The method of fabricating the sports board of the preferred embodiment of the present invention includes the steps of fabricating a core, affixing the first and second structural layers to the core, applying a mold under pressure to the sports board, shaping the sports board, applying a sealer and fabricating the truck mounting means.

The step of fabricating the core consists of a number of techniques known by those skilled in the art and will vary depending on the selection of materials. In general, a Canadian Maple core is formed by gluing together a plurality of plies with grain orientations that vary 90 degrees between adjacent layers. A plastic or glass fiber core on the other hand may be "shaped," pressed or formed within a mold.

The step of affixing the first and second structural layers may be executed in at least two ways. In the first, the individual sheets, 117A through 117F for example, are glued together to form a single full-size veneer having the overall dimensions of the sports board, the full-size veneer then being glued to the core with the grain orientation longitudinally described above. In the second method, the individual sheets, 117A through 117F for example, are individually glued to the core and may be jointed as described above. In either case, the structural layers and core are set in a mold defining the shape or contour of the final sports board and subjected to up to or above approximately 20,000 PSI and different temperatures, depending on the compound used, until the glue, resin or epoxy has cured.

After the sports board is released from the mold, the board is shaped and sanded to smooth the top and bottom surfaces as well as the sides of the board. The sports board is preferably treated with resin(s) to harden and waterproof the board. As a final step, the board is machined to include means for mounting trucks, bindings, straps including those manufactured from synthetic materials sold under the trademark VELCRO, tethers, paddles, seat(s) or the like.

Although the above description contains many specifics, these should not be construed as limiting the scope of the invention, but rather as merely providing illustrations of some of the presently preferred embodiments of this invention.

Therefore, the invention has been disclosed by way of example and not limitation, and reference should be made to the following claims to determine the scope of the present invention.

What I claim is:

1. A composite skateboard deck comprised of:

(a) a first structural layer comprised of a grass;

(b) a second structural layer comprised of a grass;

(c) a relatively light, flexible core interposed between the first and second structural layers: the core comprised of one or more plies;

(d) an adhesive for fixedly attaching the first and second structural layers to the flexible core; and (e) mounting means for receiving one or more trucks;

whereby the skateboard deck is created that is able to flexibly spring within its maximum operational range and still return to its pre-load, unflexed shape with maximal restoring force.

2. The composite skateboard deck in claim 1, wherein the grass is bamboo.

3. The composite skateboard deck in claim 2, wherein the species of bamboo is selected from the group consisting of Moso, *D. asper, D. latiflorus*, and *B. blumeana*.

4. The composite skateboard deck in claim 2, wherein at least one ply of the core is fabricated from a material selected from the group consisting of plastic, fiber glass and carbon fiber.

5. The composite skateboard deck in claim 2, wherein the core is comprised of one or more plies of wood.

6. The composite skateboard deck in claim 5, wherein the core is comprised of between five and nine plies of wood, the grain of the plies alternating 90 degrees between adjacent plies.

7. The composite skateboard deck in claim 6, wherein the plies are between 1.2 and 1.5 mils in thickness.

8. The composite skateboard deck in claim 2, wherein the bamboo is greater than 0.1 mils in thickness.

9. The composite skateboard deck in claim 8, wherein the bamboo is less than 1.5 mils in thickness.

10. The composite skateboard deck in claim 2, wherein the structural layer of bamboo is comprised of two or more sheets of bamboo peal that are jointed by means of an overlap.

11. The composite skateboard deck in claim 2, wherein the adhesive is polyester resin.

12. The composite skateboard deck in claim 2, wherein the adhesive is glue.

13. The composite skateboard deck in claim 2, wherein the adhesive is epoxy resin.

14. A method of manufacturing a composite skateboard deck, the method comprising the steps of:

(a) fabricating a core of relatively light and flexible material;

(b) affixing a first structural layer fabricated from strong, resilient material comprised of natural fiber-embedded-matrix to the core;

(c) affixing a second structural layer to the core;

(d) applying the core and structural layers to a mold under pressure;

(e) shaping the skateboard deck to remove excess materials;

(f) applying a sealer; and (g) forming a truck mounting means.

15. The method of claim 14, wherein the second structural layer fabricated from strong, resilient material comprised of natural fiber-embedded-matrix.

16. The method of claim 15, wherein the strong, resilient material comprised of natural fiber-embedded-matrix is bamboo veneer.

17. The method of claim 16, wherein the first and second structural layers are fabricated by gluing together individual sheets of bamboo veneer with an overlapping joint to create a continuous veneer the size of the deck.

* * * * *